US005685535A

United States Patent [19]

Michel et al.

[11] Patent Number: 5,685,535

[45] Date of Patent: Nov. 11, 1997

[54] SHEET FEEDING DEVICE INTENDED TO BE MOUNTED ON AN IMAGE-FORMING APPARATUS

[75] Inventors: Stéphane Michel, Montfort sur Meu; Christophe Truffaut, Rennes, both of France; Hiromichi Nagane, Yokohama, Japan; Alexandre Dodge, Pace; Marie-Hélène Froger, Chateaugiron, both of France

[73] Assignee: Canon Kabushiki Kaisha, Tokyo, Japan

[21] Appl. No.: 517,895

[22] Filed: Aug. 22, 1995

[30] Foreign Application Priority Data

Aug. 30, 1994 [FR] France ..... 94 10419

[51] Int. Cl.[6] ..... B03D 1/14

[52] U.S. Cl. ..... 271/157; 271/160; 271/164

[58] Field of Search ..... 271/162, 164, 271/157, 160, 241, 127

[56] References Cited

U.S. PATENT DOCUMENTS

| | | | |
|---|---|---|---|
| 4,623,137 | 11/1986 | Irie et al. | 271/164 X |
| 4,650,175 | 3/1987 | Wexler . | |
| 4,900,005 | 2/1990 | Blyth et al. | 271/157 X |

FOREIGN PATENT DOCUMENTS

| | | | |
|---|---|---|---|
| A0418740 | 3/1991 | European Pat. Off. . | |
| 02103162 | 4/1990 | Japan . | |
| 02113969 | 4/1990 | Japan . | |
| 3172234 | 7/1991 | Japan | 271/162 |

*Primary Examiner*—David H. Bollinger

*Attorney, Agent, or Firm*—Fitzpatrick, Cella, Harper & Scinto

[57] ABSTRACT

A sheet feeding device has a frame adapted for mounting on the image-forming apparatus, a slide sliding on the frame between a closed position in which the sheets are presented to the rollers of the apparatus and an open position for loading the sheets, a tray receiving the sheets disposed in the said slide and having an opening for distributing the sheets to the said rollers and also a loading opening, the tray being able to adopt an inclined position in which the distribution opening presents the sheets to the rollers in the closed position of the slide, and an inclined position in which the loading opening is presented to the user, in the open position of the slide, and a unit pivotally biasing the tray suitable for cooperating with the tray so as to make it pivot from one position to another in the course of the movement of the slide from the closed position to the open position, and vice versa.

15 Claims, 12 Drawing Sheets

SHEET FEEDING DEVICE INTENDED TO BE MOUNTED ON AN IMAGE-FORMING APPARATUS

The present invention relates to a sheet-feeding device intended to be mounted on an image-forming apparatus having one or more drive rollers for the sheets arranged close to the feeding device.

The present invention is particularly suitable for printers, photocopiers, or any other image-forming apparatus used in particular in an office environment.

There exist different sheet-feeding devices intended for image-forming apparatuses.

Several solutions known in the prior art call upon independent cassettes into which the paper is loaded, with the user having to remove the cassette from the image-forming apparatus in order to load the paper into it.

In a known device, the cassette is in the form of a movable slide designed to slide inside the frame of the image-forming apparatus. The slide has a feed opening disposed on one of its lateral ends through which the paper is distributed into the image-forming apparatus. This opening is parallel to the axis of rotation of the drive rollers. On the slide a support plate for the sheets is mounted, which is arranged in order to be able to pivot about an axis, which is itself parallel to the feed opening. Elastic return means bias the plate towards an inclined position, by pivoting about the axis, while the rollers for driving the sheets are provided perpendicular to said sheets in order to come into contact with the sheet disposed on the top of the pile, during the feeding of the image-forming apparatus with sheets.

This arrangement enables a predetermined position to be ensured, which always remains roughly the same for the upper sheet of the pile loaded on the plate. As the sheets are distributed in the image-forming apparatus, the pile reduces, whereas the means for biasing the plate thrust the latter towards the drive rollers, against retention tabs, towards a substantially more inclined position, so as to compensate for the reduction in the height of the pile.

In order to allow the alignment of the sheets, the slide firstly comprises a fixed reference surface and secondly a movable abutment surface, biased by a spring, these surfaces being orientated perpendicular to the plate and parallel to the feeding direction.

The retention tabs, arranged in the vicinity of the feed opening, enable the packet of sheets to be held, whilst allowing the driving of the top sheet by the above-mentioned drive rollers.

A feed device of this type is described in the U.S. Pat. No. 4,032,137, the applicant of which is CANON KABUSHIKI KAISHA.

This device, which overall is satisfactory, nevertheless has the following drawbacks.

As the user has to remove the slide in order to proceed with the loading of the paper, the image-forming apparatus, such as a telecopier, has to be installed by providing a space allowing this withdrawal. It is therefore not possible to install the image-forming apparatus in a small space.

The fact of having to withdraw the slide completely in order to commence the loading of paper means that the slide may be deteriorated by a not very careful user.

The loading of paper itself presents difficulties. In fact, the user has to install the paper so that the pile is kept in position by the separating tabs mentioned above. The user sometimes forgets this manipulation, and, for this reason, the image-forming apparatus can not be fed with paper.

In other respects, when the pile of paper is positioned, it is possible that the edges of the sheets are not superimposed in a regular fashion in relation to one another. A less careful user may then force the pile of paper between the reference surface and the movable abutment surface, as a result bending the sheets. This may result in the machine becoming jammed, in particular when the pile arrives at the level of the said sheets, and, consequently, in the feed becoming impossible.

The height of the pile of paper is not naturally limited. For this reason a user may try to cram the feed device with more sheets than it can hold.

From the above it can be seen that for some users the feed device is not convenient to use.

The present invention aims to mitigate these drawbacks since it proposes a feed device in which:

- the slide does not need to be dismantled,
- the plate is replaced by a tray in which the height of the pile of sheets is naturally limited,
- the user does not have to worry about positioning the pile of sheets correctly with respect to the separating tabs, should the occasion arise,
- loading is performed by simply allowing the pile of paper to slide, devices being provided to position it correctly in automatic manner.

In accordance with the invention the above objects are fullfiled by a sheet-feeding device intended to be mounted on an image-forming apparatus, comprising:

- a slide mounted on a frame for containing sheets, wherein said slide is movable between a close position in said frame and a open position for being loaded the sheets,
- a tray disposed in said slide for supporting the sheets,
- drive means for feeding out the sheet supported on said tray at the close position of said slide, characterised in that:
  - said tray is able to pivot about a first axis when the slide is in the close position, and to pivot about a second axis different from said first axis when the slide is in the open position.

The above objects are also fullfiled, in accordance with the invention, with a feed device including:

- a frame adapted for mounting on the image-forming apparatus,
- a slide for containing sheets and mounted on the frame to slide between a closed position in which the sheets are presented to the drive member and an open position for their loading, and being characterised in that it further includes:
  - a tray for receiving the sheets, disposed in the said slide and having an opening for distribution of the sheets to the said drive member and a loading opening, wherein this tray being able to adopt a first inclined position in which the distribution opening presents the sheets to the drive member, when the slide is in the closed position, and to adopt a second inclined position (a) in which the loading opening is presented to a outer side of the device, when the slide is in the open position,
  - means for pivotally acting on the tray suitable for cooperating with the tray so as to make the latter pivot from the first to the second position in the course of the movement of the slide from the closed position to the open position, and vice versa.

According to a particular configuration of the invention, the feed device includes:

- a frame suitable for mounting on the image-forming apparatus, a slide for containing sheets and mounted on the frame to slide between a closed position in which the sheets are presented to the drive rollers, and an open position enabling the sheets to be loaded, and is characterised in that it further includes:

a tray for receiving the sheets, disposed in the said slide and having an opening for distribution of the sheets to the said drive member and a loading opening, wherein this tray being able to pivot about a first axis parallel to that of the said rollers, and about a second axis perpendicular to the first axis means for tilting the tray including a lever mounted on the frame so as to rotate about a third axis parallel to the second axis, and a sliding abutment disposed on the slide to raise the lever, wherein the end of the lever comes into contact with the tray, so as to cause the tray to pivot about the said second axis, when the slide slides towards the open position.

Advantageously in a preferred embodiment the feed device further includes elastic return means suitable for causing the tray to pivot about the said first axis, by biasing it towards a so-called feeding position when the slide approaches the closed position and for biasing the latter towards the open position.

It will be noted that thanks to these provisions, the device according to the present invention mitigates the drawbacks mentioned above. It will also be appreciated that the elastic return means, by biasing the tray towards the feed position, permit, as in the prior art, a contact to be ensured between the upper sheet of the pile and the drive rollers during the feeding of the image-forming apparatus with sheets.

In a more preferred embodiment, the said elastic return means include an elastic blade fixed at one of its ends to the frame and the second end of which comes into contact with an abutment integral with the slide, the said blade being elastically deformed when the slide is in the closed position, so as to come into contact with the tray in order to cause the latter to rotate about the said first axis and consequently to bring the distribution opening close to the drive rollers.

In this embodiment, the elastic blade also biases the tray towards its open position. Furthermore, as it biases the tray towards the sheet-driving rollers, it therefore advantageously has two functions.

In this preferred embodiment, the slide and the tray are so arranged as to permit a translational movement of the tray on the slide in the direction of sliding of the slide, the slide having at least one abutment for guiding edges of the sheets, in the vicinity of the said loading opening, and elastic means for positioning sheets, designed to put the edge of the latter in contact with the said abutment.

These provisions are particularly advantageous, as they allow the edge of the sheets to be correctly superimposed in automatic manner inside the tray, with the result that they are presented in a correct position for entering the image-forming apparatus, i.e. during the feed phase.

In this embodiment the said abutment for guiding the sheets is advantageously able to move in the direction of sliding of the slide, while the said elastic means are designed to bias the abutment in the closing sliding direction.

It is observed that these latter characteristics are particularly simple to use.

In this preferred embodiment, the device also includes a four-legged X-shaped spring, the end of two first legs coming into abutment against an abutment surface integral with the frame, the other two legs coming into abutment against abutment surfaces integral with the slide, the X-shaped spring being designed to bias the slide towards its open position, whereas the tray also has abutment surfaces designed to cooperate with the ends of the second legs of the X-shaped spring, so as to bias the tray towards elastic thrust members for positioning the sheets arranged on the slide, the abutment surfaces of the tray being continuous with the abutment surfaces of the slide when the latter comes close to the closed position.

It is observed that the X-shaped spring is capable of performing several functions as, firstly, it exerts a part at least of the force biasing the slide towards its open position whereas, secondly, it is involved in the positioning of the sheets inside the tray. For this reason, a simplification of the structure of the device is achieved.

Other characteristics and advantages of the invention will become apparent from the following description of a preferred embodiment, with references to the attached drawings, on which:

Figure 5:
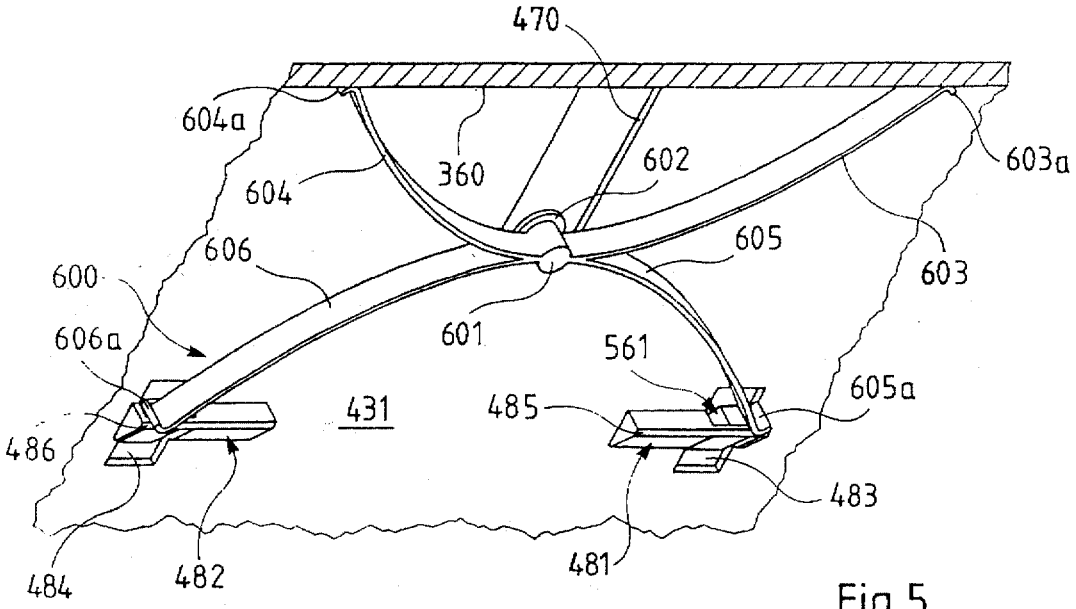
Figure 4:
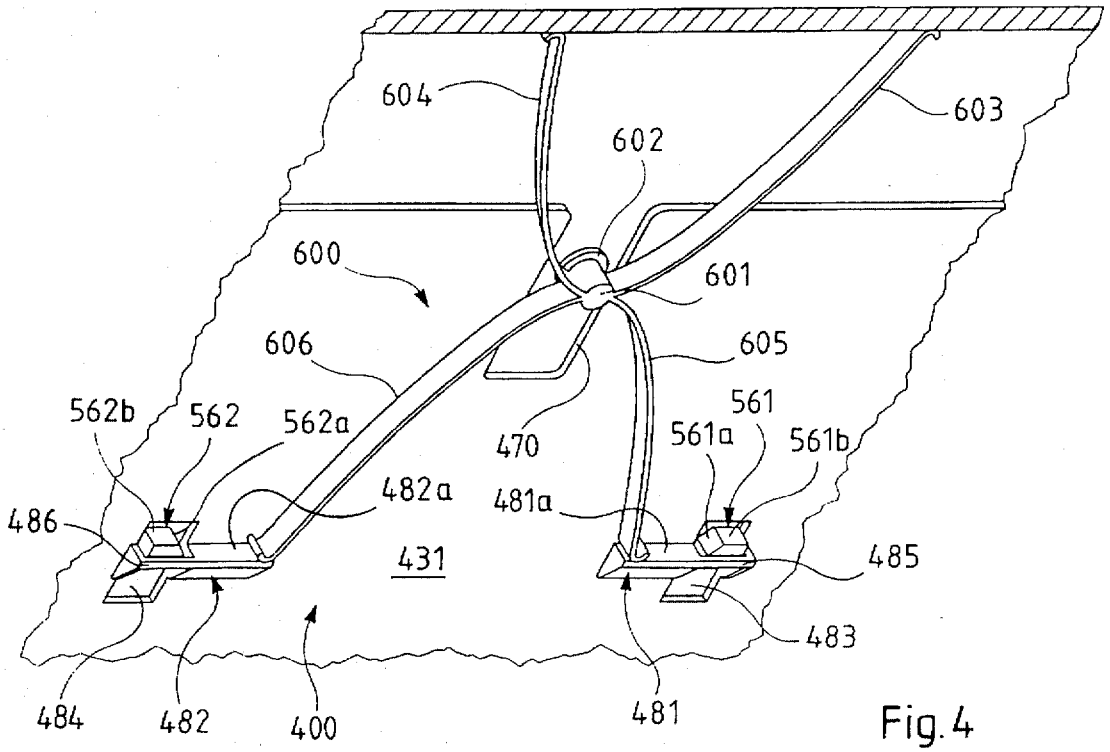
Figure 6:
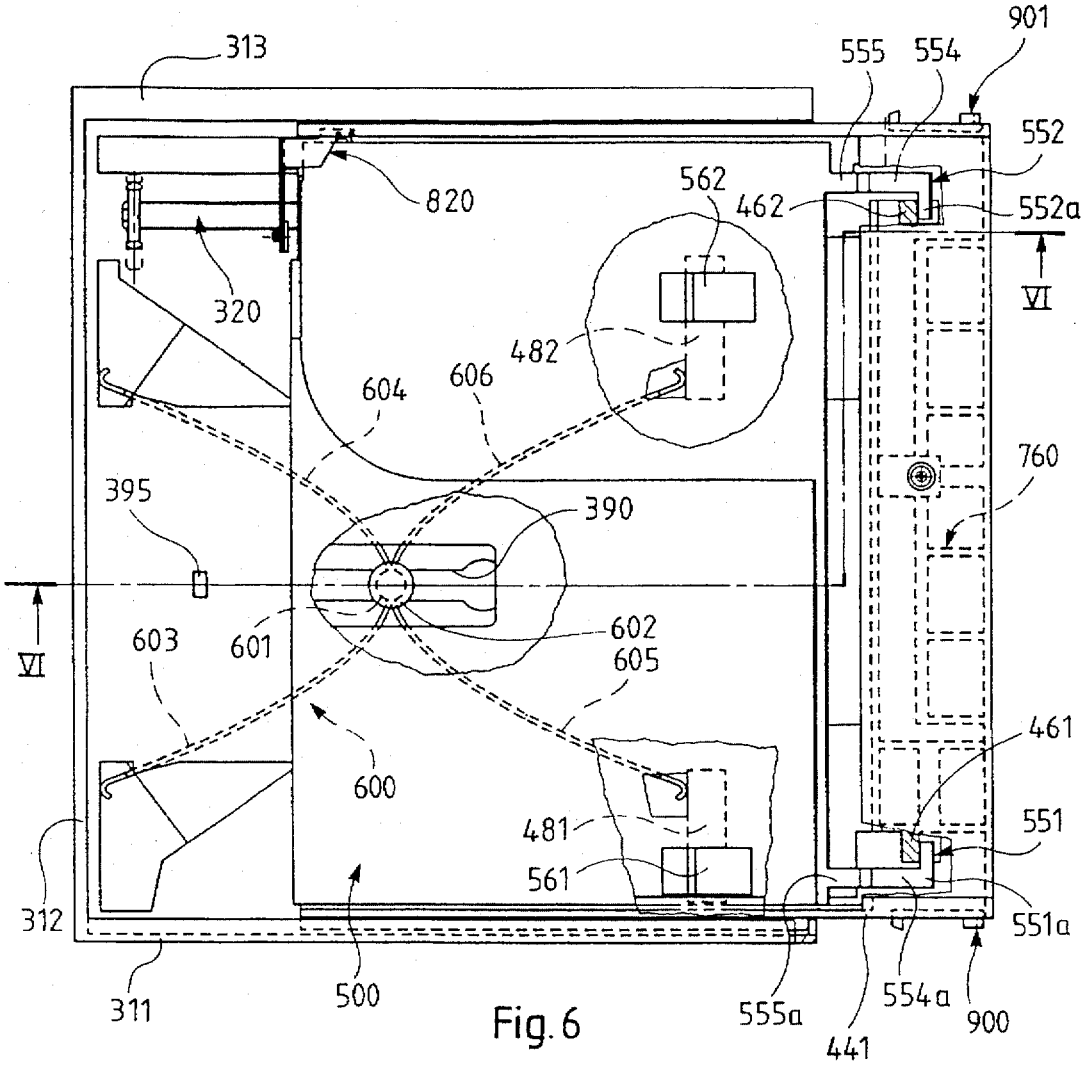
Figure 6A:
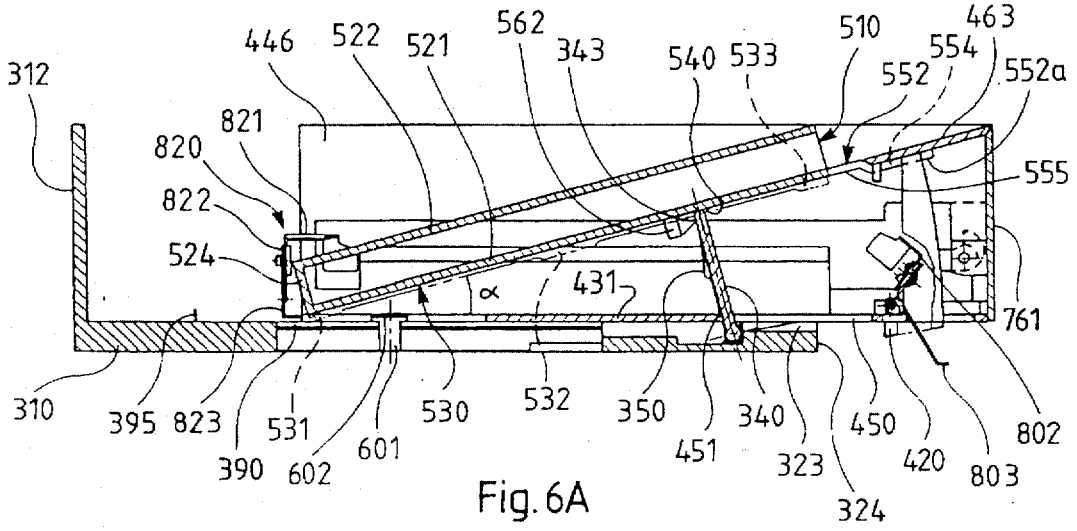
Figure 7:
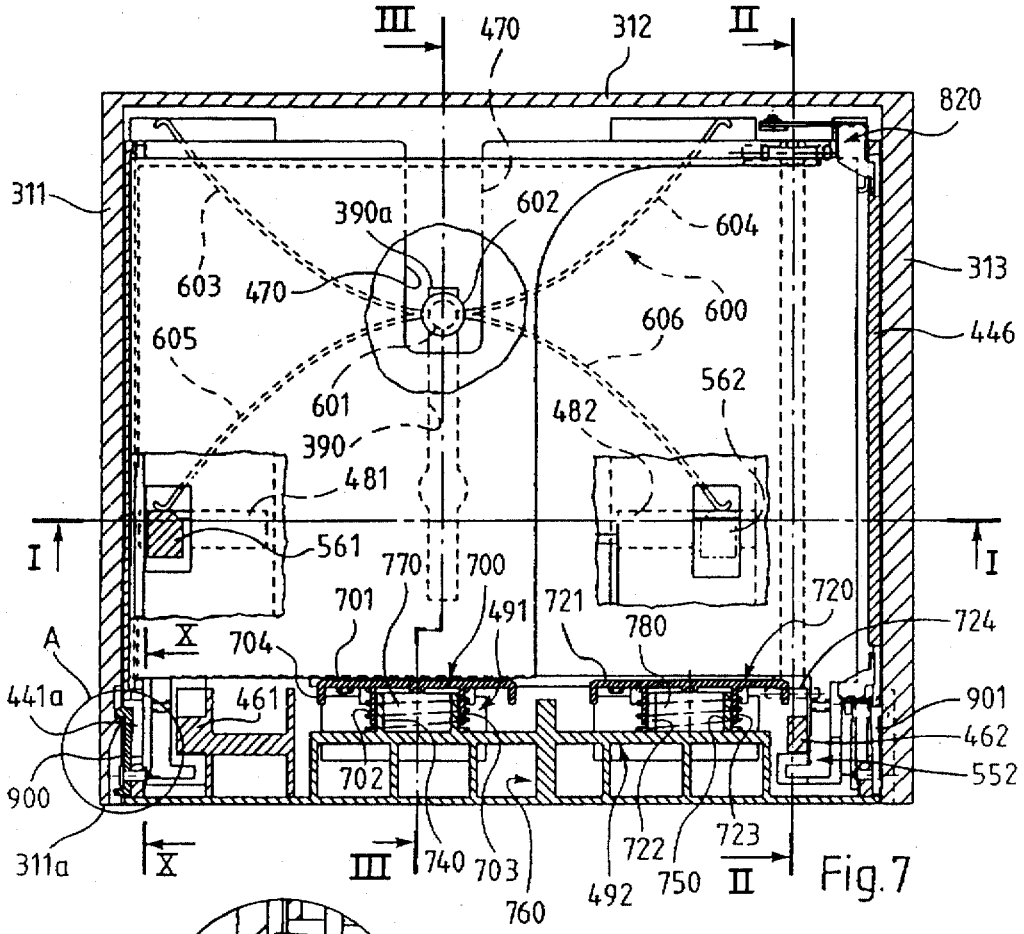
Figure 7A:
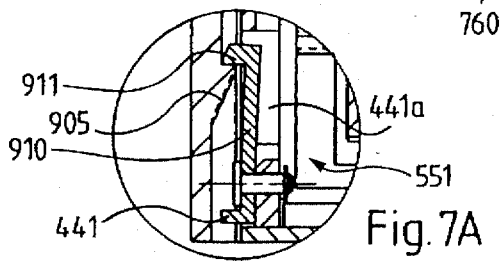
Figure 7B:
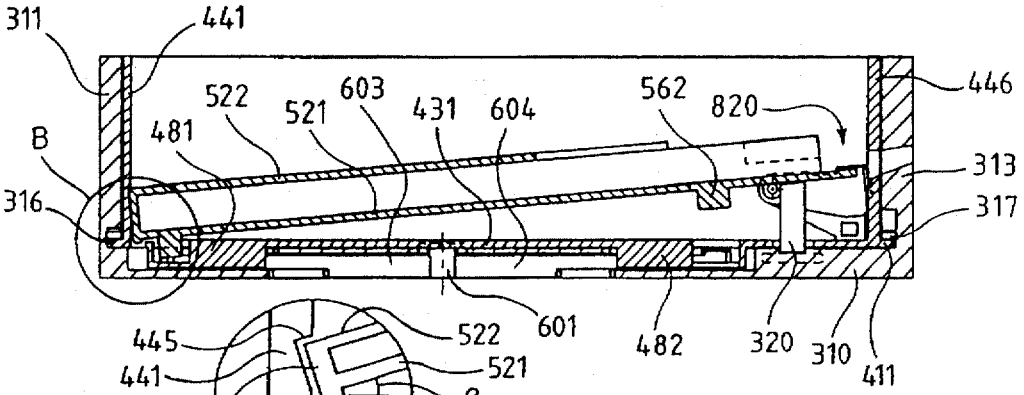
Figure 7C:
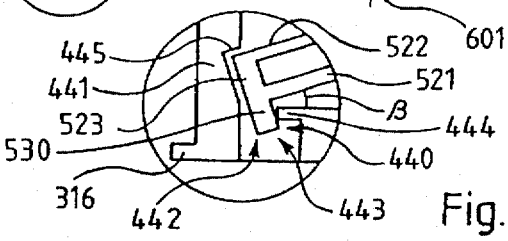
Figure 8A:
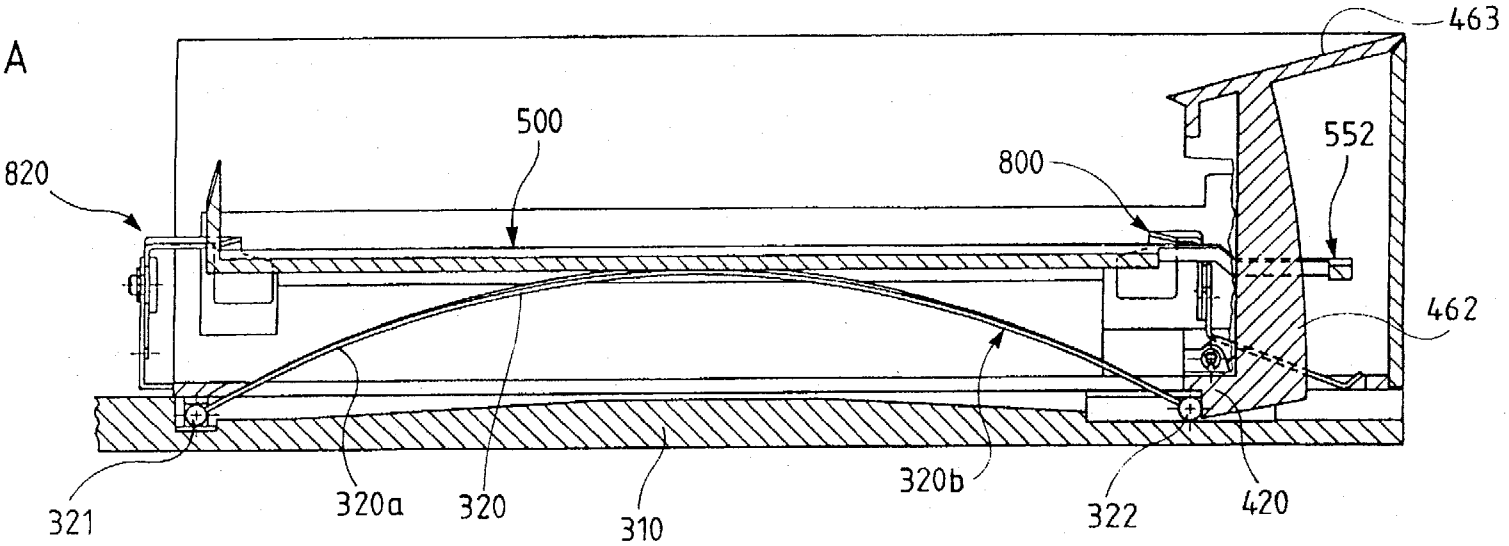
Figure 8B:
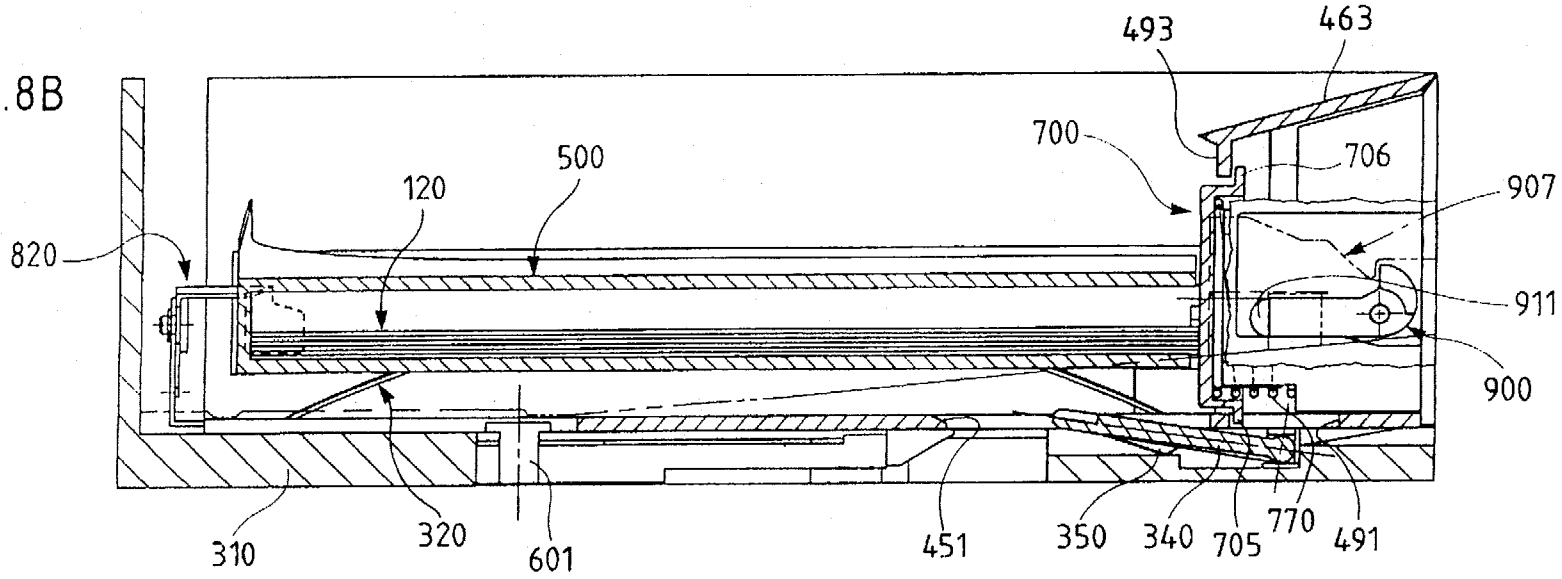
Figure 8C:
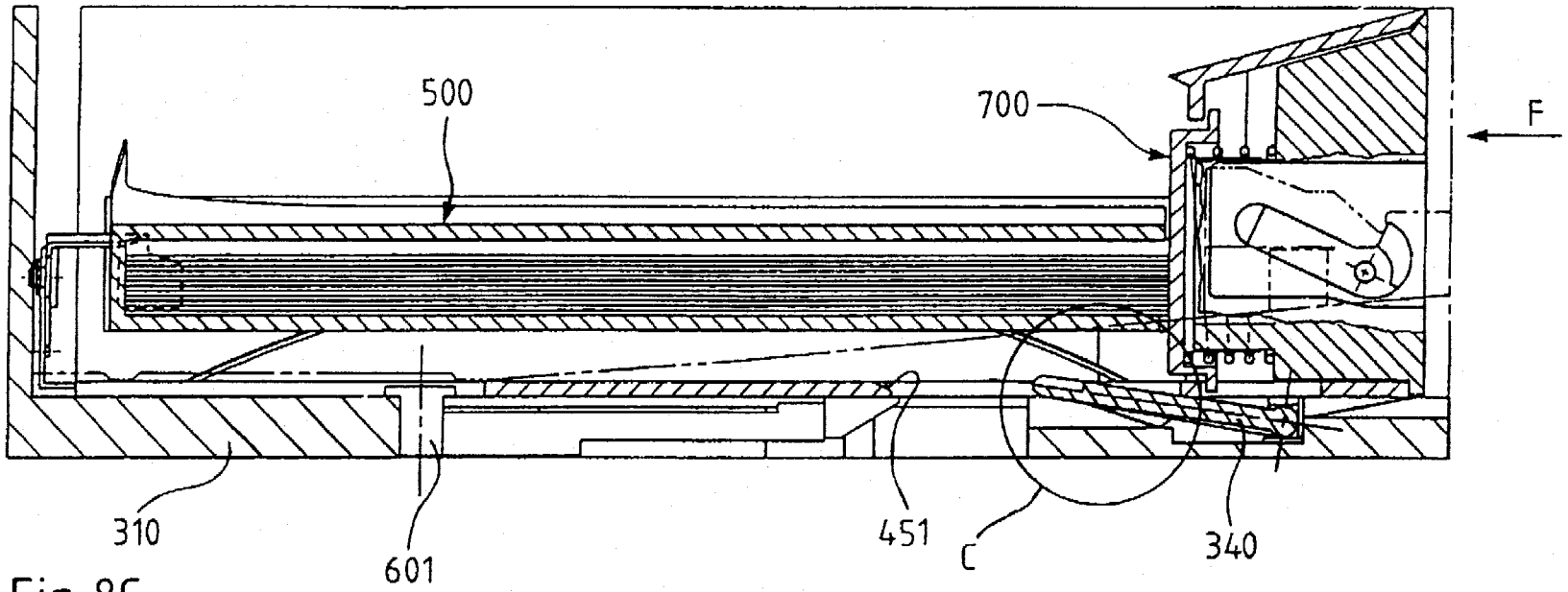
Figure 8D:
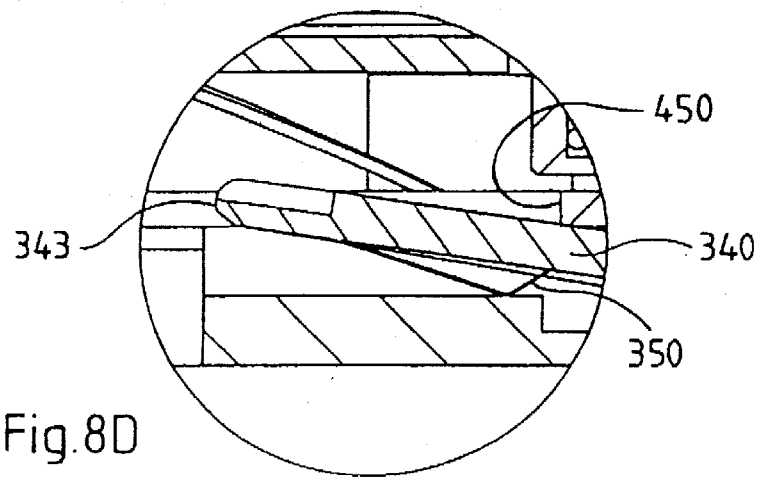
Figure 8E:
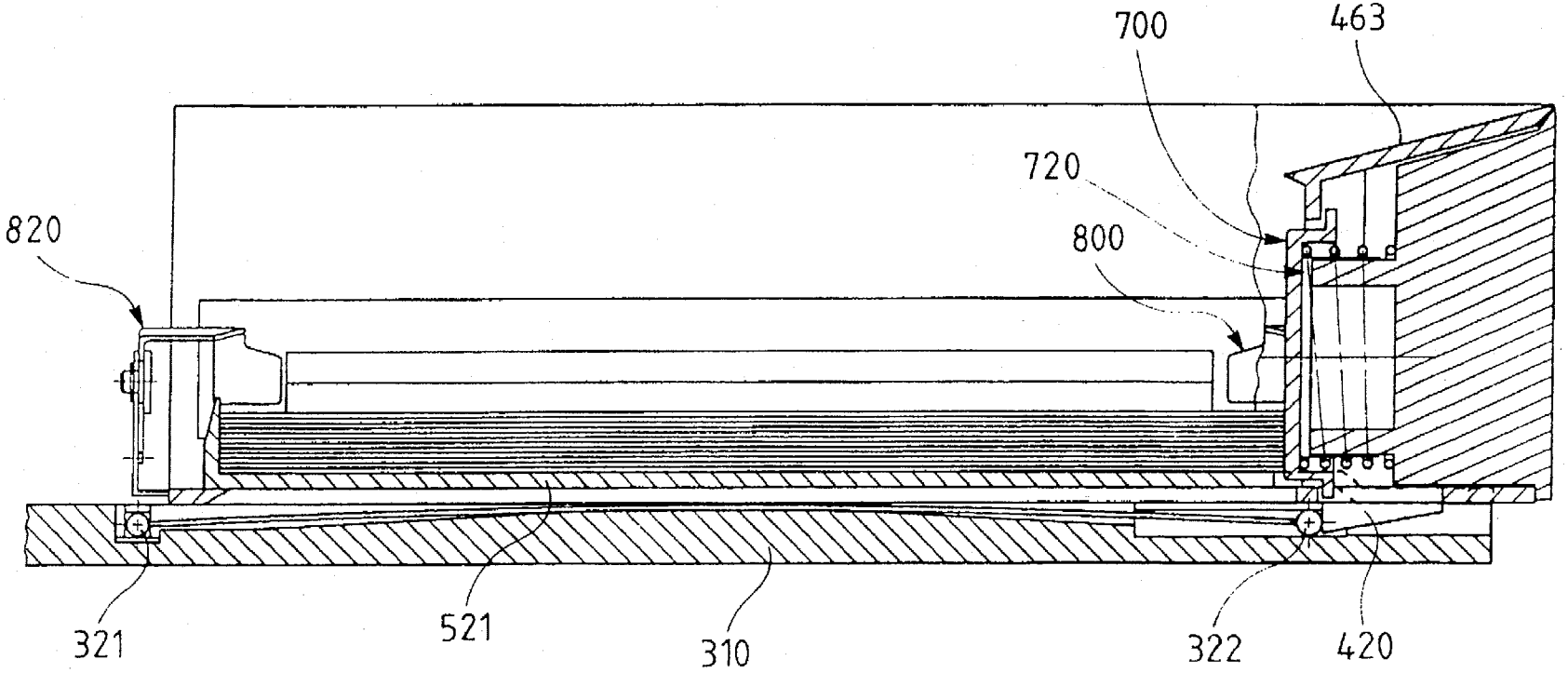
Figure 8F:
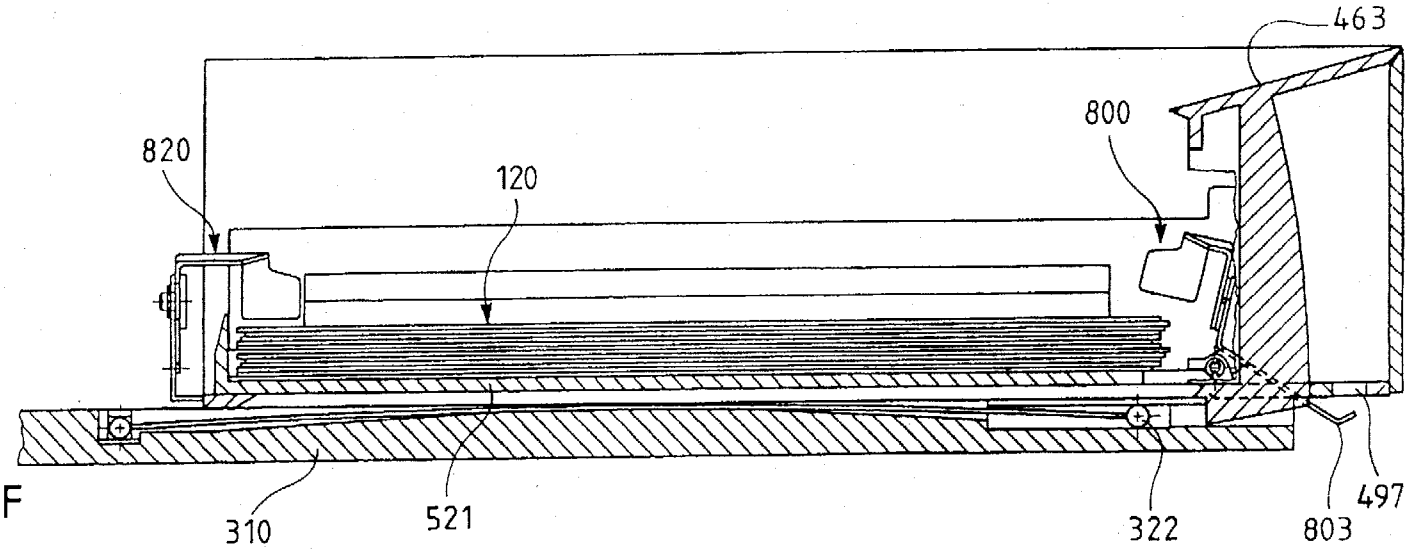
Figure 8G:
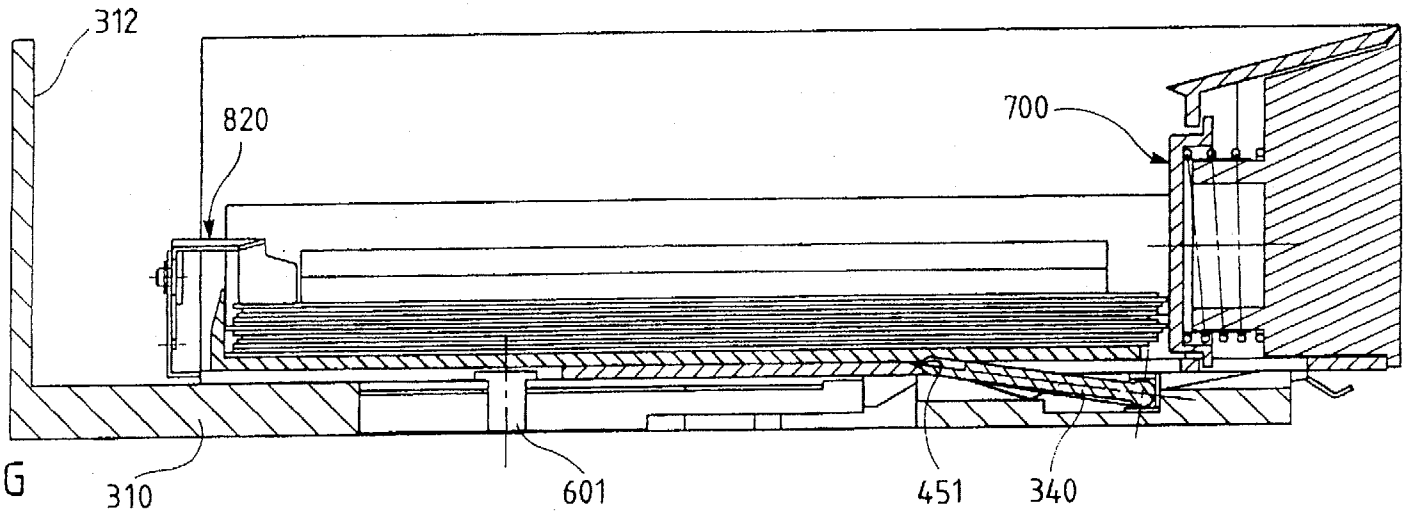
Figures 8H, 8I:
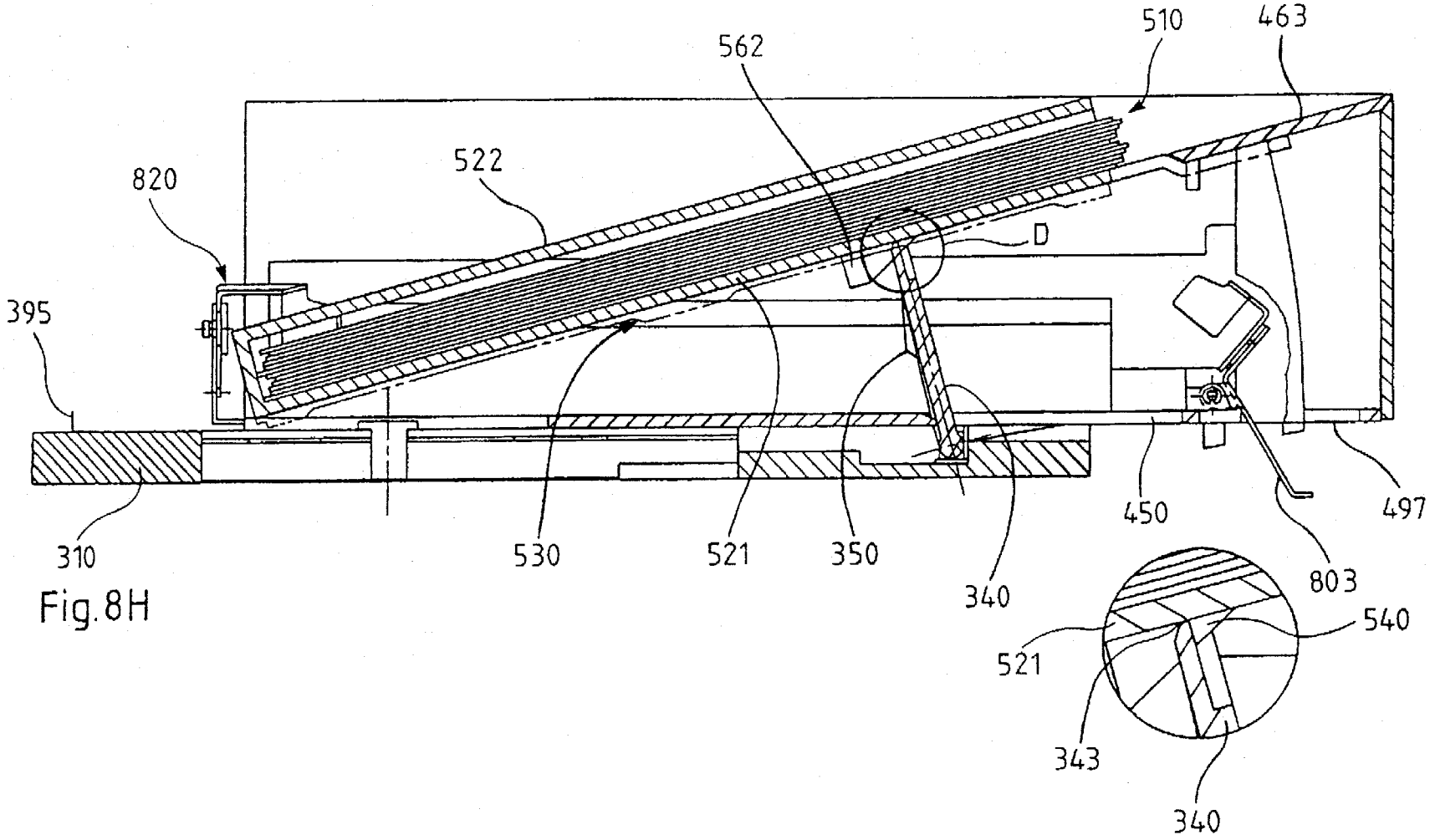
Figure 9:
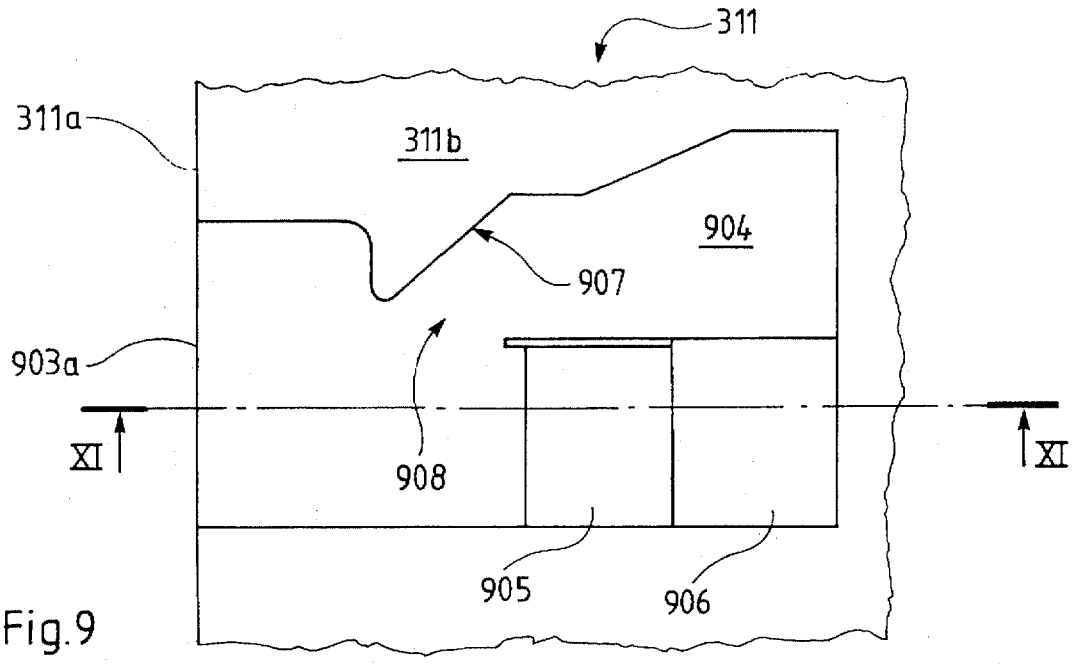
Figure 10:
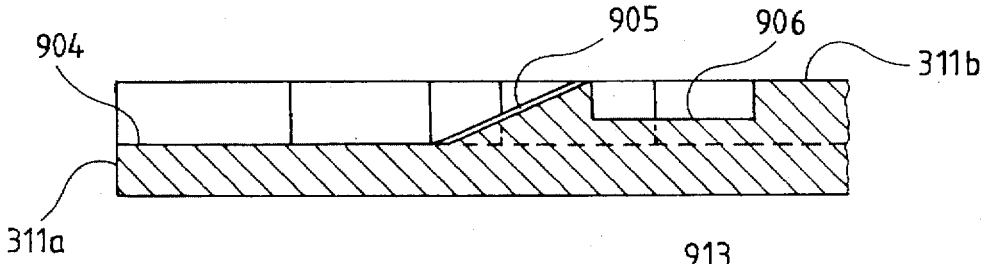
Figure 11:
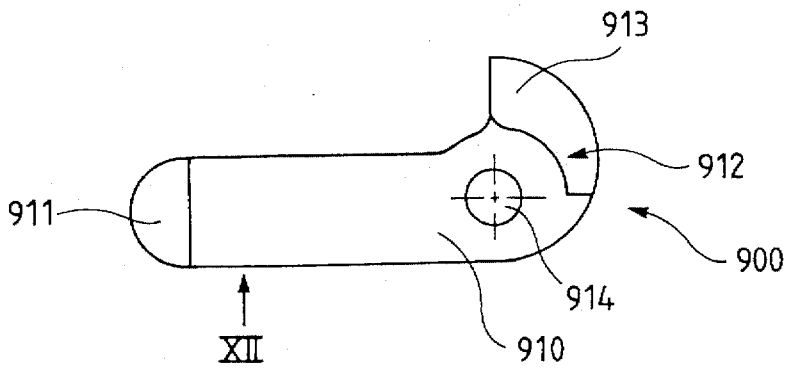
Figure 12:
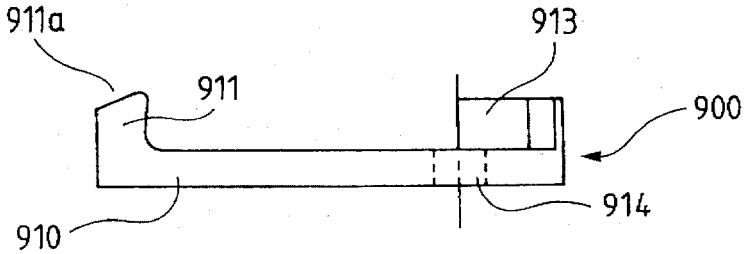

FIGS. 4 and 5 partially and diagrammatically illustrate, as a bottom view, the slide and the four-legged X-shaped spring;

FIG. 6 is a plan view, with partially cut-away portions, of the sheet-feeding device in open position;

FIG. 6A is a sectional view of the device of FIG. 6 along line VI—VI of FIG. 6;

FIG. 7 is a diagrammatical plan view, with partially cut-away portions, of this same device in closed position;

FIG. 7A is an enlarged view of a detail of inset A of FIG. 7,

FIG. 7B is a diagrammatical sectional view along line I—I of FIG. 7;

FIG. 7C is an enlarged diagrammatical view of a detail of inset B of FIG. 7B;

FIGS. 8A to 8I illustrate the opening and closing process of the sheet-feeding device, FIGS. 8A, 8E and 8F (FIGS. 8A and 8E with partially cut-away portions) being diagrammatical sectional views along line II—II in FIG. 7 and FIGS. 8B, 8C, 8G and 8H (FIGS. 8B, 8C and 8H with partially cut-away portions) being sectional views along line III—III of this same FIG. 7, whereas FIGS. 8D and 8I are enlarged views of the details of the insets C and D of the FIGS. 8C and 8H, respectively, FIGS. 8A and 8B, on the one hand, and 8F and 8G, on the other hand, corresponding to a same stage of the process;

FIG. 9 diagrammatically illustrates along the arrows X in FIG. 7 a first part of the locking means disposed in one of the lateral walls of the frame;

FIG. 10 is a sectional view along line XI-XI of FIG. 9;

FIG. 11 is a front view of a locking arm intended to cooperate with the first part of the locking means;

FIG. 12 is a view along arrow XII of FIG. 11.

Before passing to the description of the preferred embodiment, it will be noted that for reasons of clarity not all the components of the sheet-feeding device have been represented on each of the figures in which they could be visible.

Figure 1:
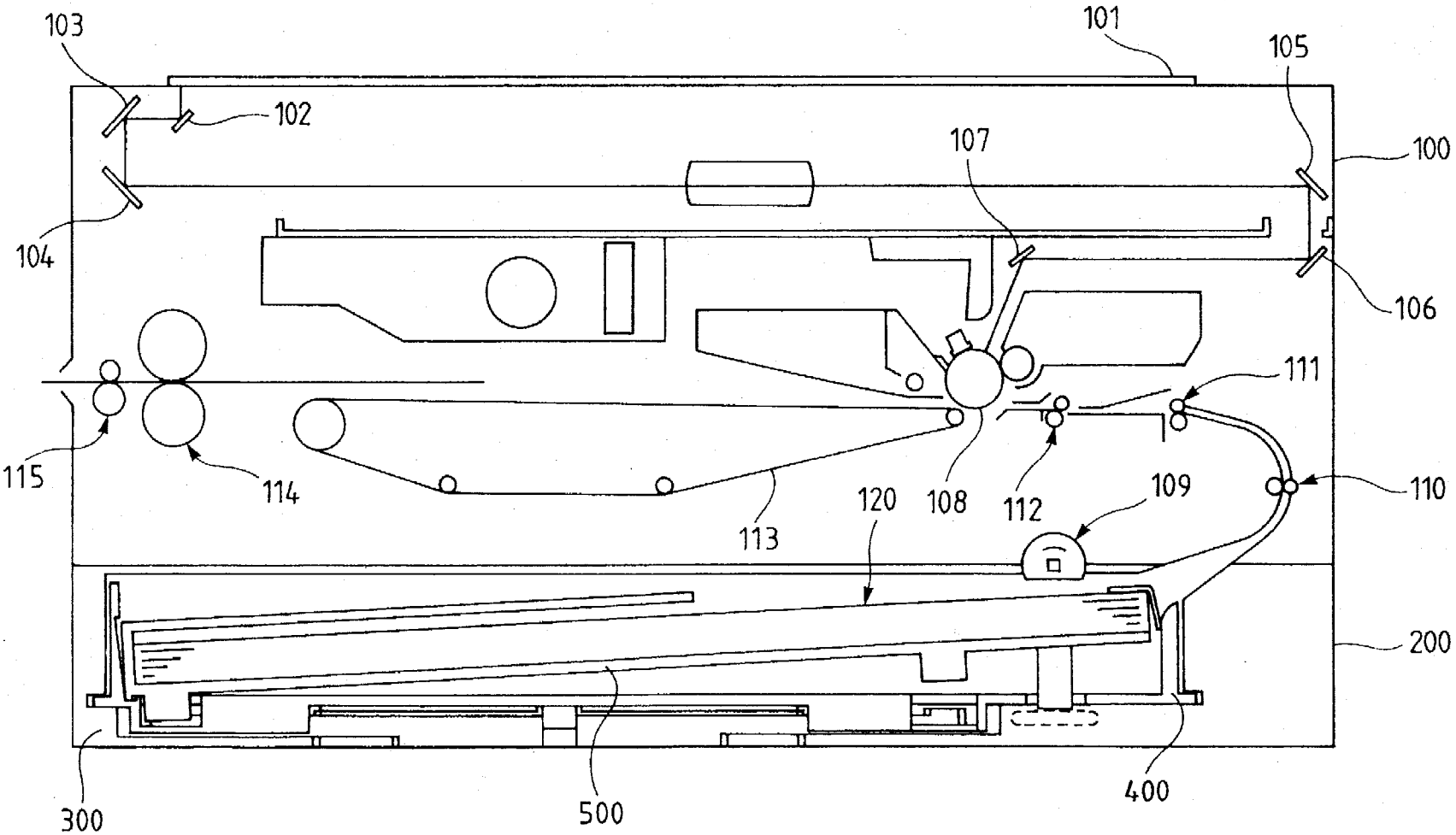
FIG. 1 is a diagrammatical sectional view representing the general configuration of an image-forming apparatus incorporating the sheet-feeding device in accordance with the preferred embodiment.

FIG. 1 represents the internal structure of an image-forming apparatus, in this particular case a photocopier, to which the present invention may be applied. The apparatus represented on FIG. 1 comprises a main body 100 of a copying machine having at the same time an image-reading function and an image-recording function.

The main body 100 comprises an exposure glass 101 intended to receive the originals. A lamp (not represented) comes to illuminate the original, the luminous beam reflected by the original being brought by a set of mirrors 102 to 107 onto a photosensitive drum 108.

The sheets 120, on which the recording of the images coming from the originals is performed, are brought to this photosensitive drum 108 from a sheet-feeding device 200, in accordance with the preferred embodiment of the present invention, by means firstly of an alignment of drive rollers 109, then of alignment rollers 110 to 112. These rollers 109 have a truncated circular cross section.

Once the toner image on the photosensitive drum 108 has been transferred onto a sheet, said sheet is conveyed by a conveyor belt 113 towards a fixing device 114, then the sheet is discharged by the discharge rollers 115.

The different essential parts of this image forming apparatus will not be described in further detail, as it is of a classical structure.

The sheet-feeding device 200, in accordance with the preferred embodiment of the present invention and mounted on the main body 100, will now be described.

The sheet-feeding device 200 is shown in more detail on the following figures.

Figure 2:
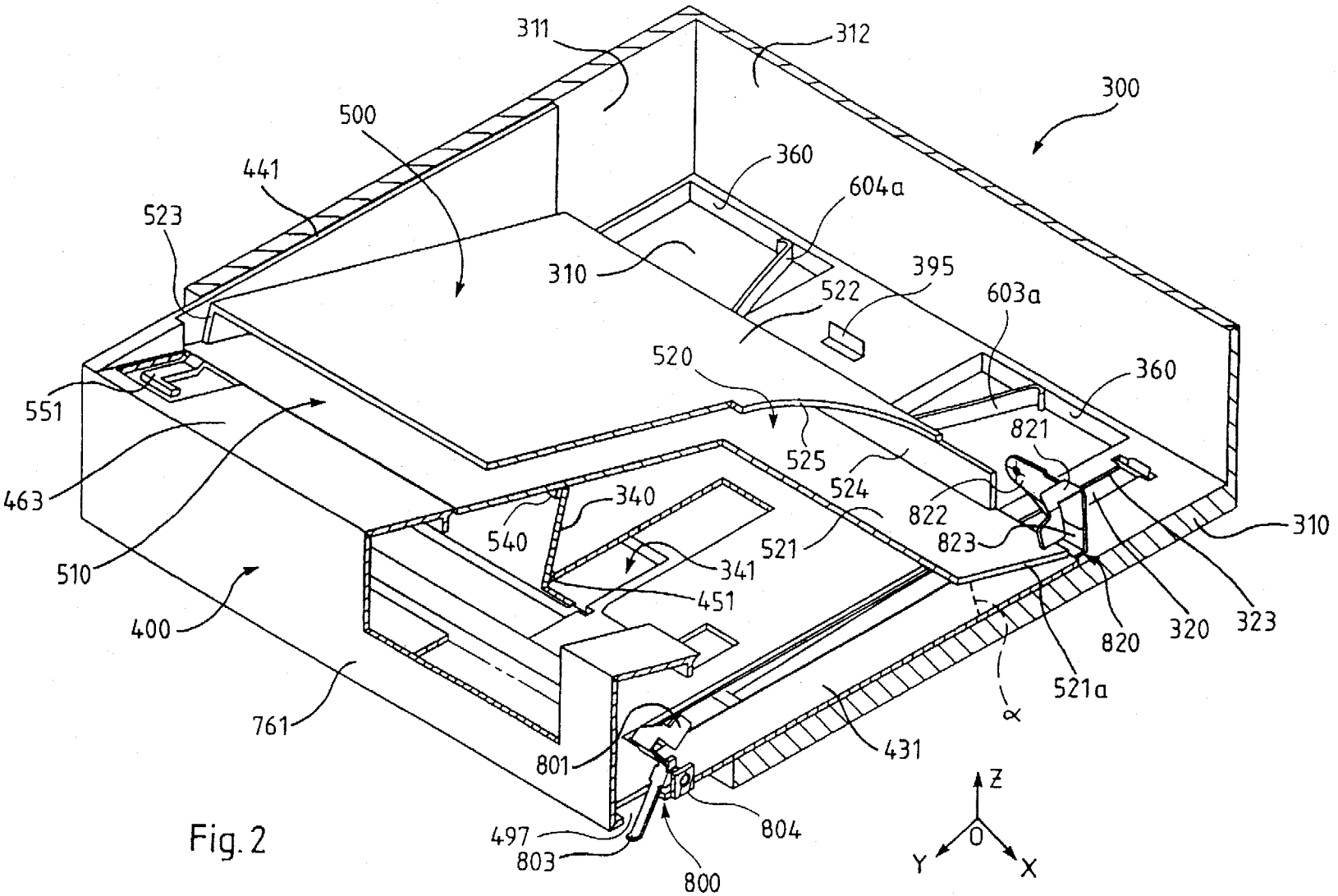
FIG. 2 is a perspective diagrammatical view, with partially cut-away portions, of the sheet-feeding device in open position.

With reference to FIG. 2, this device has a frame 300 on which a slide 400 is mounted to slide.

As illustrated in FIG. 1, this frame 300 is suitable for mounting on an image-forming apparatus 100 in order to feed it with sheets, close to members for driving sheets of the type of the roller bearing the reference 109.

The frame 300 has a rectangular bottom 310 and also a first, a second and a third lateral wall 311, 312 and 313 (see FIG. 7B in particular) connected to one another and perpendicular to the bottom 310. The third lateral wall 313 is parallel to the first wall 311. The sliding of the slide 400 on the bottom 310 of the frame 300 is guided laterally by two longitudinal notches 316 and 317 (see FIG. 7B in particular) provided respectively in the first and third lateral walls 311, 313 in the vicinity of the bottom 310. The slide has two complementary lateral ribs 410, 411 which come to slide respectively in the notches 316 and 317.

The slide 400 is mounted so as to slide on the frame 300 between a closed position (see FIG. 3) in which the sheets of the feeding device 200 are presented to the drive rollers 109 and in which it is kept in position thanks to the locking means, described in greater detail below, and an open position (see FIG. 2) permitting the loading of the sheets into the device 200.

For this purpose, and as will also be described in further detail below, the sheets 120 are loaded into a tray 500 disposed in the slide 400, and having a sheet-loading opening 510 and a sheet-distribution opening 520 to the drive rollers 109, and said tray 500 is also able, by successive pivoting:

- on the one hand, to adopt a first inclined position in which the distribution opening 520 presents the sheets to the drive rollers 109 (see FIG. 3, in which the sheets are not represented), when the slide 400 is in the closed position,
- and, on the other hand, to adopt a second inclined position in which the loading opening 510 is presented to the user, when the slide is in the open position (see FIG. 2).

The sliding movement from the closed position to the open position of the slide 400 is performed in particular thanks to an elastic blade 320 fixed at one **320*a* of its ends to the frame 300 and the second end 320*b* of which comes into contact with an abutment 420 integral with the slide 400**.

The elastic blade 320 has a rectangular longitudinal section and at its two ends (**320*a*, 320*b* respectively) bears two transversal pivots (321, 322** respectively).

This blade is held in a housing 323 made in the bottom 310 of the frame, so as to be disposed parallel to the first lateral wall 311 and close to the third lateral wall 313 of the frame 300 (see FIG. 7B).

The housing 323 has a width similar to that of the blade 320, except on its part the furthest from the second lateral wall 312 of the frame, where this housing 323 has the width of the pivot 322.

The housing 323 also opens on the outside at the level of the edge 324 of the bottom 310 of the frame opposite the second wall 312, in order to allow the abutment 420 of the slide to come into contact with the blade 320, the latter making the slide 400 slide towards the open position when it springs back, whereas it is bent under the effect of the abutment 420 when the slide 400 is thrust towards its closed position (see FIG. 6A in which only the end of the housing 323 and the abutment 420 are visible).

This bending and this return to an inoperative position is possible thanks to the plastic material in which the blade was moulded and thanks to the sliding of the pivot 322 in the housing 323.

The bending of the blade 320 is intended to cause the tray 500 disposed in the slide 400 to pivot about a first axis defined more precisely below, parallel to the axis of rotation of the drive rollers 109 (direction Oy of the orthonorm reference mark in FIGS. 2 and 3).

This pivoting is intended to bring the tray 500 into the first inclined position in which the sheets are presented to the drive rollers 109.

The slide 400 has a longitudinal slot 430 provided in its bottom 431 and facing the blade 320 when the slide 400 is mounted on the frame 300, so as to let said blade pass during its bending, in order to be able to come into contact with the tray 500 and cause it to pivot.

The tray 500 has a rectangular base plate 521 coming into contact with the elastic blade 320 and an upper plate 522, connected to the base plate 521 by two lateral plates 523, 524 for keeping the sheets in position.

The loading opening 510 is provided over the length of the tray 500, parallel to the wall 524 and it is in particular defined by the space existing between the lower plate 521 and the upper plate 522. The distribution opening 520 is in particular formed by a rounded cut-out 525 extending overall transversally in the upper plate 522, which provides an access space to the rollers 109. It will be noted that the edge **521*a* of the lower plate 521** is free.

The upper plate 522 is thus shorter than the base plate 521 of the tray 500 in order to enable the drive rollers 109 situated perpendicular to the tray, when the feed device is mounted on the image-forming apparatus 100, to come into contact with the sheets disposed in the tray and to drive the one of the top of the pile outside the tray and towards the photosensitive drum 108 of the apparatus 100.

It is also observed that the open part on the top of the tray upwardly extends not only the distribution opening 520, but also the loading opening 510, facilitating the loading of the sheets through the latter. The ease of loading is further improved thanks to the rounded cut-out 525 of the upper plate 522, which is at first straight, then is inwardly curved in the vicinity of the longitudinal lateral plate 524 of the tray 500, so as to guide the sheets during their loading, towards the inside of the tray 500 and to keep them in position there.

In order to restrict certain parasitic movements of the tray 500, the latter is provided with a rib 530 protruding from the base plate 521 over the width and at the end thereof, directly below the lateral plate 523. This rib 530 has a variable height so as to form three contact areas 531–533, namely two end areas 531, 544 and one central area 532 (see FIG. 6A).

A recess 440 (FIG. 7C) provided in the bottom 431 of the slide along a first lateral wall of the slide 441 is intended to receive this rib 530, over all or part of its length, according to the position of the tray 500. Over a half of its width, this recess 440 forms a slot 442 for receiving the rib 530, whereas on the other half 443 it penetrates into the bottom of the slide so that the latter has a protruding part 444 forming an abutment for the rib 530. This second recess half 443 is only formed in the bottom 431 of the slide at the places intended to receive the contact areas 531–533 of the rib 530, whereas the first half 442 covers the entire length of the first lateral wall 441.

The two halves 442, 443 of the recess, at the site of the contact areas 531–533, open on the outside of the bottom side of the bottom of the slide.

The slot part 442 of the recess 440 is adjacent to the first lateral wall 441 of the slide perpendicular to the bottom 431 of the latter. This first lateral wall 441 of the slide has a notch 445 over its entire length, adjacent to the slot 442 of the recess 440 and forming a dihedron, here at right angle. This notch 445 is formed so that when the tray 500 is in the inclined sheet distribution position (FIG. 3), it receives by the complementary nature of shapes the corresponding corner of the tray.

Thus, thanks to the arrangement described with the assistance of FIG. 7C, the rotation of the tray 500 about the axis Oy is restricted to the angle β, here equal to 5°, its translational movement along axis Oz and its rotation along axes Ox and Oz being also restricted when it is in this distribution position.

More precisely, thanks to the shape of the recess 440 and to the rib 530:

- the tray 500 again has a correct horizontal position during the sliding of the slide 400 towards the closed position, after it has been in the inclined sheet-loading position,
- in the inclined position for distributing the sheets to the drive rollers 109, the translational movement along the axis Ox and the rotation along axes Oy and Oz are restricted by the contact areas 531–533 of the rib 530 coming into abutment against the protruding part 444 forming an abutment for the bottom 431 of the slide.

During the pivoting of the tray 500 towards the position for distributing the sheets to the drive rollers 109, the translational movement along Oy is also restricted by the elastic thrust member described below.

It will be observed here that the first axis of rotation of the tray 500 is essentially represented by the connecting line between the lateral wall 523 and the base plate 521.

The means bringing the tray 500 from a horizontal position to an inclined sheet-loading position (angle a of 15°, FIG. 2) will now be described.

A lever 340, in the form of a rectangular plate, is mounted on the frame 300 so that it can rotate, in a corresponding cavity 341 by means of two pivots (not visible on the FIGS.).

The axis of rotation of the lever also known as the third axis of rotation is parallel to a second axis of rotation of the tray 500 represented by the connecting line between the base plate 521 of the tray and its longitudinal lateral wall 524 (direction Ox).

The third axis of rotation is also situated close to the free edge 324 of the frame opposite its second lateral wall 312.

In order to be able to make the lever 340 pivot, the slide 400 has an opening 450 having substantially the same shape as the lever.

This opening 450 is provided in the bottom 431 of the slide so that when the elastic blade 320 springs back in order to bring the slide 400 into an open position, one 451 of its edges comes to abut against the free edge 343 of the lever parallel to the extension direction of the pivots, and makes this lever pivot about its axis of rotation.

In other words, a sliding abutment integral with the slide, in this particular case the edge bearing the reference 451, cooperates with the lever 340 when the slide slides towards the open position in order to raise this lever.

During its pivoting the lever 340 comes into contact with the lower surface of the base plate 521 of the tray and brings the latter for this reason to pivot about its second axis of rotation (parallel to the axis Ox).

Once the loading opening has arrived in the sheet-loading position (angle a, FIG. 2), the lever comes to abut against a stop rib 540 protruding from the base plate of the tray (FIGS. 1 and 8I).

A leaf spring 350 is mounted beneath the lever 340 in order to allow it to protrude from the bottom 310 of the frame and to the edge 451 of the opening of the bottom of the slide to pass beneath the lever in order to cause it to pivot (see for example FIG. 8D).

In this respect, the edge of the lever and of the opening of the slide coming into contact with one another at the beginning of the rotational movement of the lever, in order to make the lever rock, are bevelled according to complementary shapes so as to facilitate the beginning of the movement of erection of the lever (see for example FIG. 8C).

The stiffness of the spring 350 is chosen so that it is sufficient to support the lever 340 slightly protruding in relation to the frame without for all that the lever coming to raise the tray when it is in a non-pivoted position.

The tray 500 also bears two L-shaped feet 551, 552 protruding from the base plate 521 thereof on the side of the loading opening 510, each in the vicinity of a longitudinal end of the tray.

The shortest arms (551*a*, 552*a*) of the Ls extend towards one another parallel to the edge of the base plate 521 bearing them.

These latter arms are intended each to slide along a curved surface formed by a guide 461, 462 protruding from the bottom of the slide, perpendicular to the latter (see FIGS. 6 and 6A; these guides have not been represented in FIG. 1).

The tilting of the tray 500 (rotation about the second axis) is thus advantageously guided and a translational movement of the tray in a direction opposite to the opening sliding direction of the slide is limited during this latter operation.

The guides 461, 462 are topped by an inclined wall 463 in a single piece therewith. The inclination of the wall 463 is chosen so that it extends the inclined plane formed by the base plate 521 of the tray when it is in the sheet-loading position (angle a).

This inclined wall 463 is also integral on either side of the two lateral walls 441, 446 of the slide erected perpendicular to the bottom 431 of the slide. Thus, when loading the sheets, the latter are advantageously guided by the lateral walls 441, 446 of the slide and the inclined wall 463 before penetrating into the tray.

In this respect it will be observed that the longest arms of the L-shaped feet 551 (respectively 552) of the tray have two parts, one 554 (respectively 554*a*) of which is set back with respect to the other 555 (respectively 555*a*), so that in the sheet-loading position, one 555 (respectively 555*a*) extends the bottom of the tray to the inclined wall 463 and the other 554 (respectively 554*a*) comes to abut beneath the bottom of this latter wall.

The sheet-feeding device 200, according to the preferred embodiment, also has a four-legged X-shaped spring 600 which is suitable for biasing the tray 500 towards elastic thrust members for positioning the sheets disposed on the tray 400.

In fact, as shown on FIGS. 8E and 8F, when the tray arrives in the horizontal position (FIG. 8G) after having adopted the inclined loading position (FIG. 8H), the sheets are not perfectly superposed in the direction of the width.

In order to avoid any problem of jamming, it is therefore preferable to align automatically the edges of these sheets in the direction of the width (function of the four-legged X-shaped spring), the latter having already been aligned in the direction of the length by the two lateral walls 441, 446 of the slide.

The four legs (see FIGS. 2, 4 and 5 in particular) are each arced and are integral at one of their ends with stud 601 crowned by a cylindrical head 602, whereas at their other end, these legs are curved back.

The bottom 310 of the frame is for its part recessed in order to receive this spring so that:

- the ends (603*a*, 603*a*) of two first legs 603, 604 come to abut against an abutment surface 360 integral with the frame and parallel with the second axis and can slide therealong (see FIG. 2 and diagrammatical representations in FIGS. 4 and 5);
- the two other legs 605, 606 can perform a symmetrical sliding movement, in relation to the stud of the spring, to that of the first two legs 603, 604; and
- the head 602 of the stud 601 is guided by a slot 390 to make a translational movement parallel to the axis Oy, during the sliding of the legs of the spring, the slot communicating with the recessed part of the bottom receiving the legs of the X-shaped spring.

In this respect the slide has a notch 470 in its bottom so as not to interfere with the translational movement of the head of the stud.

The other two legs 605, 606 of the spring each come into abutment against two protuberances 481, 482 provided on the bottom of the slide and offering these legs an abutment surface, respectively 481*a*, 482*a*, and sliding surface, parallel to the second axis.

Each of these abutment surfaces of the slide is disposed next to a slot 483, 484 made in the bottom of the slide and each intended to allow complementary protuberances 561, 562 protruding downwardly from the base plate 521 of the tray to pass, and to slide in the opening and closing direction of the slide.

As can be better seen on FIGS. 4 and 5, which are underneath views of the slide, the protuberances 481, 482 of the slide have respectively a small bar 485, 486 which straddles the slots 483, 484.

The complementary protuberances 561, 562 of the tray also have abutment surfaces adapted to cooperate with the second legs 605, 606 of the X-shaped spring 600. Each complementary protuberance 561, 562 has two abutment surfaces forming a dihedron. On FIG. 4, the abutment surfaces of the protuberance 561 are visible and bear the references 561*a*, 561*b*. When the slide slides towards the closed position (FIG. 4 then 5), the small bar 485 comes to straddle the protuberance 561 and there is a continuity of abutment surfaces 481*a*, 561*a* and 561*b*, the surfaces 481*a* and 561*b* being parallel to the second axis, offset and joined by the surface 561*a*. A symmetrical arrangement is provided at the level of protuberance 562.

When the slide arrives towards its closed position (FIG. 5), the free ends of the legs 605, 606 of the X-shaped spring 600 slide along the abutment surfaces 481*a*, 482*a*. When they arrive at the level of the junction between the surfaces 481*a* (symmetrical surface 482*a*) and the oblique abutment surface 561 (symmetrical surface 562*a*), the free end of each leg 605, 606 slides on these oblique abutment surfaces. The ends 605 and 606 of the X-shaped spring 600 then exert a thrust on the protuberances 561, 562 and repel them until the free end of the legs 605, 606 comes into contact with the abutment surfaces 561*b*, 562*b*. The abutment surfaces 561*b* and 562*b* are then coplanar with the abutment surfaces 481*a* and 482*a*. The backwardly curved end of the legs 605, 606 is then in abutment not only with the surfaces 561*b* or 562*b* but also against the bars 485 and 486.

Thus the X-shaped spring 600 compressed in the closed position of the slide, comes, after the freeing of the locking means, to complement the elastic blade 320 in order to drive the slide 400 towards the open position by biasing the abutment surfaces 481, 482 integral with the slide by spring-back.

The protuberances 561, 562, which are integral with the tray 500, bias, in cooperation with the spring 600, the tray towards the elastic thrust members 700, 720 mentioned above, which are described in further detail below. The X-shaped spring 600 therefore advantageously has two functions.

It will also be observed that the X-shape of the spring 600 advantageously permits maximum energy storage during its compression and a symmetrical thrust on the protuberances of the slide and of the tray.

The elastic thrust members 700, 720 are formed in this particular case of two substantially rectangular plates 701, 721, two roughly semi-cylindrical segments 702, 703, 722, 723 protruding on one of the faces of each of these plates 701, 721. Each of these pairs of segments is respectively mounted on a concentric cylindrical section 740, 750 protruding from a base 760 detachably mounted on the slide, a helical spring 770, 780 being respectively disposed between the plate 701, 721 and the base 760 concentrically to the sections and to the cylindrical segments (see FIGS. 3 and 7).

The mounting of the plates on the base and of the mounting plate on the slide is such that they are parallel to the second axis and perpendicular to the first.

Figure 3:
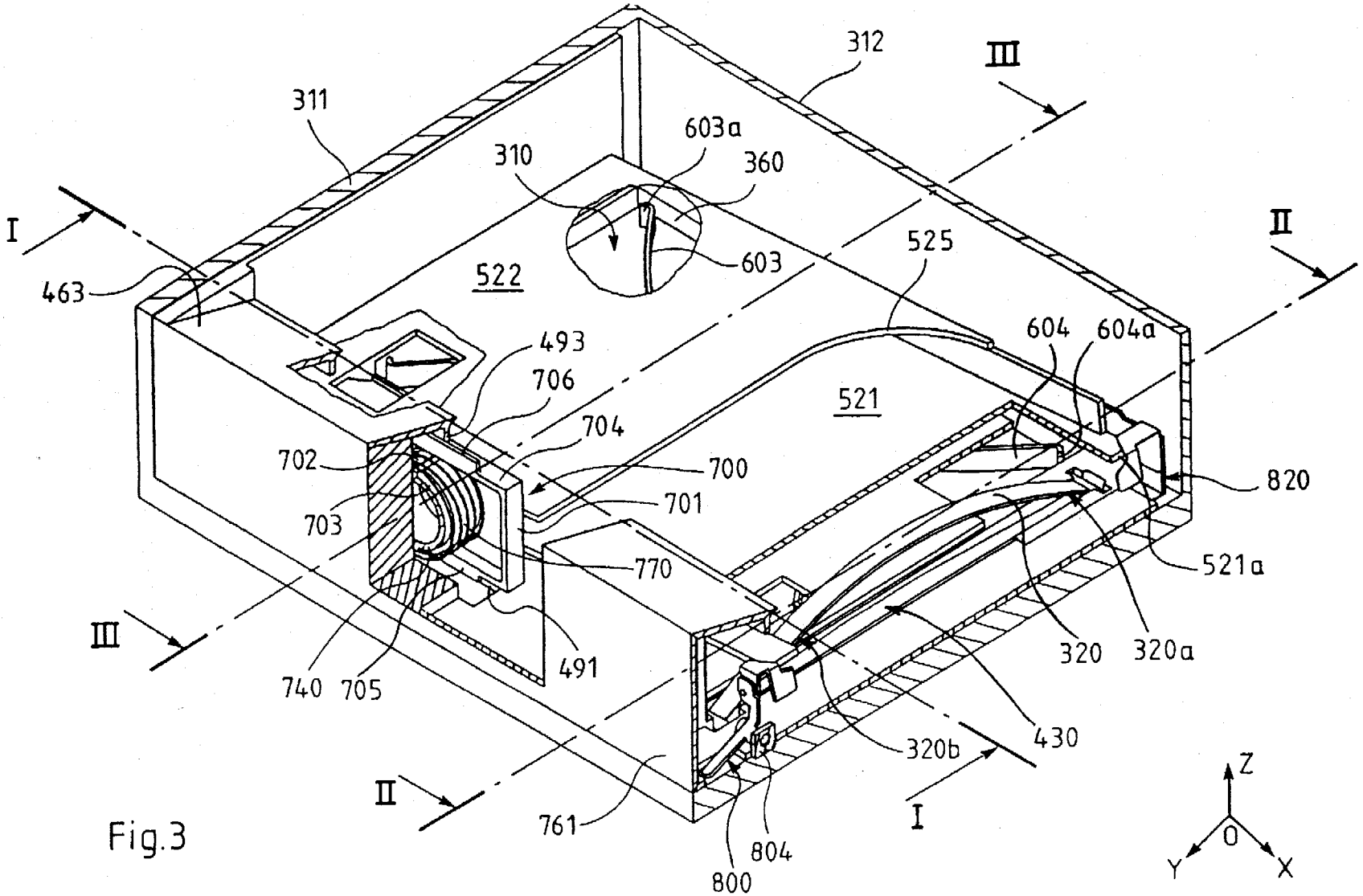
FIG. 3 is a perspective diagrammatical view, with partially cut-away portions, of this same device in closed position.

Each of these plates has a peripheral edge 704, 724 extending in the direction of the semi-cylindrical segments 702, 703, 722, 723 and extended at the upper and lower ends of the plate by abutment ribs 705, 706 extending substantially over the length of the plates (only those of plate 701 have been given a reference on FIG. 3).

In the position in which the plates 701, 721 are at the maximum distance in relation to the base 760 (springs 770, 780 in position of rest), the abutment ribs 705, 706 come to bear, one 705 against an edge of an opening 491 provided in the bottom of the slide, and the other 706 against an extension 493 of the inclined wall 463 of the slide. A symmetrical arrangement is provided for the plate 721.

The base 760 is itself extended by a rear wall 761 producing the junction between the two lateral walls 441, 446 and also the bottom 431 and the inclined wall 463 of the slide.

Thus during the closing movement of the slide 400 (i.e. from the position illustrated in FIG. 8H to that illustrated in FIG. 8A, without passing through the stage of FIG. 8C), more precisely in the vicinity of the closed position (FIG. 8E), the X-shaped spring comes to bias the tray 500, at the level of the protuberances 561, 562, by a translational movement in the slide 400 in the opening sliding direction, towards the plates 701, 721 of the thrust members, whereas the latter are biased by helical springs 770, 780 in the opposite direction, allowing the edges of the sheets 120 to be aligned, by a contact of the thrust members 700, 720 with the sheets at the level of the loading opening 510, the opposite edges, in the direction of the width, being in abutment against the longitudinal lateral wall 524 of the tray.

In this respect, it will also be noted that the translational movement of the head of the X-shaped spring 600 is stopped by the edge 390*a* of the slot 390 so that the deformation of the second legs 605, 606 is produced sufficiently early before the pivoting of the tray 500 towards the inclined sheet-distribution position to the drive rollers 109.

Furthermore, the protuberances 481, 482 extend through slots 483, 484 in order to retain with the bars 485, 484 as described above the X-shaped spring 600 when the tray 500 passes by pivoting towards this inclined position for distributing sheets to the drive rollers 109.

The person skilled in the art will know how to choose the number and the length of the elastic thrust members 700, 720 and also the stiffness of the springs 770, 780 in order to hold the sheet in the best way at the moment when it is grasped by the drive rollers 109.

In this respect, the thrust force of the thrust member 720 next to the distribution opening is chosen so as not to interfere with the action of the elastic blade 320, or of the retention members which will now be described.

Before passing to the description of these sheet retention members, it will be noted that an L-shaped copper tab 395 (see FIG. 2) is fixed to the bottom 310 of the frame, so that the shortest arm of the L protrudes slightly through the notch 470 formed in the bottom of the slide, so as to come into contact with the bottom of the tray at the moment of the sliding of the slide 400 towards the open position. This copper tab in fact allows the tray 500 to be retained in the slide 400 when the slide slides towards the open position, therefore making the tray perform a translational movement inside the slide in the direction opposite to the sliding direction towards the open position. One thus avoids a disadvantageous contact of the sheets with the elastic thrust members 700, 720 when the tray performs its rotation in order to pass into the sheet-loading position. This tab may be assisted in this by the friction of the lever 340 beneath the tray 500.

The retention members 800, 820, of which there are two, are intended to retain the packet of sheets 120 disposed in the tray, whilst permitting the driving of the top sheet by drive rollers 109 when the tray is in the inclined sheet distribution position.

Each of these members comprises a right-angled part 801, 821 suitable for resting freely on the upper angle formed by the packet of sheets at the level of the distribution opening 520 and is disposed so as not to interfere with the grasping of the sheets by the drive rollers 109.

For this purpose, each of the right-angled parts 801, 821 is extended by a first arm 802, 822 pivoted to rotate on a second arm 803, 823 about an axis parallel to the axis of rotation of the drive rollers, in order to be able to follow the rotation of the tray during its rotation about the first axis, and to stop it if necessary.

One 823 of the second arms 803, 823 is integral with the bottom of the slide at one end thereof in the direction of the width and it is fixed. The other second arm 803 is substantially L-shaped and mounted so that it can rotate.

The first arm 802 of the right-angled part 801 is pivoted to rotate on the shortest lug of this L-shaped arm 803, while the latter is rotationally mounted, in the angle formed by the lugs of the L, on a bearing 804 fixed to the bottom 431 of the slide, at the other end in the direction of the width, so as to allow a rotation of the L-shaped arm about an axis parallel to the second axis.

Furthermore, an opening 497 is provided in the bottom of the slide beneath the longest lug of the L so that during the sliding movement of the slide towards the open position, the said lug drives, because of its weight, the retention member 800 to pivot about the axis parallel to the second axis. Thus, this member will not interfere with the rotation of the tray 500 about the second axis.

During the closing operation, the longest lug of the L comes to abut against the bottom of the frame, which brings the retention member 800 into its position in which the right-angled part 801 comes to rest on the top of the packet of sheets, the tray being in a horizontal position on the slide.

Thanks to these retention members 800, 820:

the upper part of the packet of sheets is retained and, the top sheet of the packet is capable of being able to be driven by the drive rollers 109 without the rest of the packet being affected by the movement of the drive rollers 109.

We will now pass to the description of the means for locking the slide onto the frame, with reference to FIGS. 7A and 9 to 12.

These locking means on the one hand comprise two elastic locking components 900, 901 having a symmetrical structure mounted so as to rotate respectively on a lateral wall 441, 446 of the slide 400 about an axis parallel to the second axis.

On the other hand, these locking means have projections cut in the first 311 and third 313 lateral walls of the frame, designed to cooperate with the locking components 900, 901, both for locking and unlocking the slide on the frame.

As the structure of the locking means is symmetrical, only the means illustrated on the left side of FIG. 7 will be described below.

These projections protrude from a notch 903*a* provided in the lateral wall 31 from the edge 311*a* thereof, which notch has a set-back surface 904 parallel to the interior surface 311*b* of the lateral wall 311 of the frame.

On a lower half of the notch, a first sloping projection 905 protrudes from the set-back surface 904 until returning to the level of the interior surface 311*b* of the lateral wall 311, roughly in the median area in the direction of the length of the notch.

This projection is extended by a second projection 906 forming a surface parallel to the set-back surface, and right to the right-hand longitudinal end (on FIG. 9) of the notch.

On the upper half of the notch, a pointed projection 907 protrudes from the set-back surface 904, whilst leaving a clearance 908 to remain between the end of the point of the pointed projection 907 and the sloping projection 905. This point, oriented towards the lower half of the notch, is also situated closer to the edge of the lateral wall 311*a* than the sloping projection 905.

The elastic locking member 900 is made up of an arm 910 extended, at its two ends respectively and transversally, by a bevelled head 911 and a body 912 comprising an unlocking abutment 913 extending perpendicular to the head.

The arm 910 also has, in the vicinity of this unlocking abutment, a bore 914 enabling it to be mounted so as to rotate on the lateral wall 311 of the slide 400.

This mounting is performed so as to allow, when the slide is closed, the bevelled head 911 to come to slide along the projections of the lower half of the notch, advantageously thanks to its bevelled part 911*a*.

Because of the sloping projection and the space occupied over the width by the head 911 and the arm 910, the latter is progressively forced to bend elastically towards a clearance space 441*a* (FIG. 7) formed in the lateral wall 441 of the slide next to this arm, before the head comes to abut against the projection 906.

In this position, the cooperation of the head 911 of the arm 910 and of the edges of this latter projection 906, enables the slide 400 to be prevented from sliding, i.e. that it is locked on the frame.

The bending stress imposed on the arm 910 in this locking position, in the direction of the clearance space 441*a*, prevents any unlocking caused by possible vibrations of the frame.

A subsequent thrust on the slide brings the unlocking abutment to abut against the point of the pointed projection 907, which causes the arm 910 to pivot, and consequently the head 911 to pass into the upper part of the notch 903*a*.

As the elastic blade 320 and the X-shaped spring 600 then bias the sliding slide, the head 911 will slide on the set-back surface 904 of the upper half of the notch 903*a* until it is again outside the frame 300, by passing in particular between the pointed projection 907 and sloping projection 905 at the level of the clearance 908.

The operation of the sheet-feeding device will now be described.

In the closed position of the slide 400, the tray 500 is in the inclined position in which the distribution opening 520 presents the sheets to the drive rollers 109 (FIGS. 1, 3, 8A and 8B). As the tray becomes empty, the elastic blade 320 which was stressed on a central area towards the bottom of the slide, on account of the load of the tray, comes to reassume its maximum bending position (FIG. 8A) bringing the tray into the position of maximum inclination (angle β). Thus the sheets are constantly in position to be grasped by the drive rollers 109.

In this respect, it will be noted that for the formation apparatus of the type of that described with reference to FIG. 1, as long as the rollers are not activated in order to feed the photosensitive drum with sheets, their truncated part is presented to these sheets and the sheet-feeding device is mounted so that these rollers 109 do not touch the pile of sheets, so as not to risk displacing the latter, the sheet edges of which are ideally superposed, or are in the process of being superposed.

When the rollers 109 are activated, the device is also mounted so that these rollers come by their circular part to lower the pile of sheets, in opposition to the elastic force of the elastic blade 320, thus ensuring adequate friction between them and the sheet situated on the top of the pile, this friction being chosen to be greater than the friction between two sheets and between the sheet and the tray 500 (in the case of the last sheet in the tray).

When the tray is empty, or when the user wishes it, the latter comes to exert a thrust force (force F) on the slide towards the inside of the frame (FIG. 8C) in order to free the locking means in the manner described above. The resilience of the elastic blade 320 makes the slide 400 slide on the frame towards the open position, assisted by the resilience of the X-shaped spring 600.

Because of the resilience of the elastic blade 320, the tray also passes to a horizontal position (FIG. BE) then, whereas the slide 400 slides towards the open position (FIGS. 8E and 8H), the tray held by the copper tab 395 performs a translational movement inside the slide in the opposite direction to the sliding movement towards the open position, in order to move the sheets away from the area of the elastic thrust members 700, 720. Thus any subsequent jamming during the rotation of the tray towards the inclined sheet-loading position is avoided. At the same time as the retention member 800 performs its rocking (FIGS. 8F to 8H), the tray 500 is progressively brought into the sheet-loading position by a rotation about the second axis, thanks to the rocking lever 340 rotated by the corresponding abutment 451 of the slide, during the sliding of the latter towards the open position.

The tray thus arrives in the maximum inclined sheet-loading position shown in FIGS. 2, 6A and 8H, which position corresponds to an angle of 15° in relation to the bottom of the slide.

After having loaded the tray, the user pushes the slide in the closing sliding direction, causing the different components of the feed device to perform the operations in the reverse order to those which have just been described for the movement of the slide into the open position, except that here the tray 500 operates a relative translational movement in relation to the slide but in the opening sliding direction, under the bias of the X-shaped spring 600, here assisted by the copper tab 395, so as to bring the sheets into contact with the elastic thrust members 700, 720.

In other embodiments one will be able to provide for covering the underpart of the bottom 431 of the slide and the bottom of frame 310 with Teflon strips in order to improve the sliding of the slide on the frame, just like the underneath of the base plate of the tray and the top of the bottom 431 of the slide, in order to improve the sliding of the tray towards the elastic thrust members 700, 720 when the tray is biased by the X-shaped spring.

Similarly, one will be able to cover the free edge of the rocking lever 340 with Teflon in order to eliminate the frictional forces with the tray 500, but also to cover the inside of the tray 500 with Teflon in order to improve the sliding of the sheets therein, and also the bevelled part of the protuberances 561, 562 of the tray in order to assist the sliding of the X-shaped spring thereon.

In other respects, one will be able to provide stiffeners for the X-shaped spring 600, in the form of superposed elastic blades joining the legs of the spring two-by-two in the direction of the compression and of the spring-back, so as to increase the force of this spring.

It will also be possible to supplement the elastic blade 320 by four additional support lugs of the tray.

The person skilled in the art will also know how to adapt the sheet-feeding device, in accordance with the present invention, to sheet-grasping means other than the drive rollers.

Although the invention has been described with reference to a particular embodiment, it is in no way restricted to this but, on the contrary, includes any variant which does not depart from the scope of the spirit of the invention.

We claim:

1. A sheet-feeding device (200) intended to be mounted on an image-forming apparatus (100), comprising:

a slide (400) mounted on a frame for containing sheets, wherein said slide is movable between a closed position in said frame and an open position for loading the sheets, a tray (500) disposed in said slide for supporting the sheets, drive means (109) for feeding out the sheets supported on said tray at the closed position of said slide, and means for pivoting said tray about a first axis when the slide is in the closed position and means for pivoting said tray about a second axis different from said first axis when the slide is in the open position.

2. A sheet-feeding device according to claim 1, characterised in that said first axis is disposed parallel to a moving direction of said slide from the closed position to the open position and said second axis is disposed perpendicular to the first axis.

3. A sheet-feeding device according to claim 2, characterised in that said drive means feeds the sheets on the tray in a direction perpendicular to the moving direction of said slide.

4. A sheet-feeding device (200) for mounting on an image-forming apparatus (100) having a drive member (109) for feeding sheets (120), comprising:

a frame (300) adapted for mounting on the image-forming apparatus, a slide (400) for containing sheets and mounted on the frame to slide between a closed position in which the sheets are presented to the drive member and an open position for their loading, a tray (500) for receiving the sheets, disposed in said slide and having an opening (520) for distribution of the sheets to the said drive member and a loading opening (510), wherein this tray being able to adopt a first inclined position in which the distribution opening presents the sheets to the drive member, when the slide is in the closed position, and to adopt a second inclined position in which the loading opening is presented to a outer side of the device, when the slide is in the open position, and means for pivotally acting on the tray suitable for cooperating with the tray so as to make the tray pivot from the first to the second position in the course of the movement of the slide from the closed position to the open position, and vice versa.

5. A sheet-feeding device (200) for mounting on an image-forming apparatus (100) having drive member (109) for feeding sheets (120), comprising:

a frame suitable for mounting on the image-forming apparatus, a slide (400) for containing sheets and mounted on the frame to slide between a closed position in which the sheets are presented to the drive member, and an open position enabling the sheets to be loaded, a tray (500) for receiving the sheets, disposed in said slide and having an opening (520) for distribution of the sheets to the said drive member and a loading opening (510), wherein the tray is able to pivot about a first axis parallel to that of the said rollers, and about a second axis perpendicular to the first axis, biasing means for causing the tray to pivot about the first axis, and means for tilting the tray including a lever (340) mounted on the frame so as to rotate about a third axis (342) parallel to the second axis, and a sliding abutment (451) disposed on the slide to raise the lever, wherein the end (343) of the lever comes into contact with the tray, so as to cause the tray to pivot about the said second axis, when the slide slides toward the open position.

6. A sheet-forming device (200) for mounting on an image-forming apparatus having a drive member (109) for feeding sheets, comprising:

a frame (300) adapted for mounting on the image-forming apparatus, a slide (400) for containing sheets and mounted on the frame to slide between a closed position in which the sheets are presented to the drive member and an open position for their loading, a tray (500) for receiving the sheets, disposed in the said slide and having an opening (520) for distribution of the sheets to the said drive member and also a loading opening (510), wherein the tray is able to pivot about a first axis, parallel to that of the said drive member, and about a second axis perpendicular to the first axis, an elastic blade (320), fixed at one (**320*a*) of its ends to the frame and the second end of which comes into contact with an abutment (420) integral with the slide, the said blade being elastically deformed when the slide approaches the closed position, so as to come into contact with the tray in order to cause the tray to rotate about the said first axis and consequently bring the distribution opening close to the drive member, and means for tilting the tray including a lever (340) mounted so as to rotate on the frame about a third axis (342) parallel to the second axis, and a sliding abutment (451) disposed on the slide to raise the lever, wherein the end (343**) of the lever comes into contact with the tray, so as to cause the tray to pivot about the said second axis, when the slide slides towards the open position.

7. A feed device according to any one of claims 4 to 6, further comprises complementary means (600, 481, 482) for driving the slide towards the said open position.

8. A feed device according to any one of claims 4 to 6, characterised in that the slide (400) and the tray (500) are so arranged as to permit a translational movement of the tray on the slide in the direction of sliding of the slide, the slide having at least one abutment (700, 720) for guiding edges of the sheets, in the vicinity of the said loading opening, and elastic means (770, 780) for positioning sheets, designed to put the edge of the latter in contact with the said abutment.

9. A device according to claim 8, characterised in that the said abutment (700, 720) for guiding the sheets is able to move in the said direction of sliding of the slide, while the said elastic means (770, 780) are designed to bias the abutment in the closing sliding direction.

10. A feed device according to any one of claims 5 or 6, characterised in that the slide and the tray are so arranged as to permit a translational movement of the tray on the slide in the direction of sliding of the slide, the slide having at least one abutment (700, 720) for guiding sheets perpendicular to the first axis and biased by elastic means (770, 780) in the direction of closing of the slide, the abutment being so arranged as to be in contact with the edge of the sheets in the vicinity of the loading opening (510), the device (200) also having complementary elastic means (600) biasing the tray towards the said abutment when the slide comes close to the said closed position.

11. A device according to one of claims 1 to 6, characterised in that the device further comprises a four-legged X-shaped spring (600), the end (**603*a*, 603*a*) of two first legs (603, 604) coming into abutment against an abutment surface (360) integral with the frame, the other two legs (605, 606) coming into abutment against abutment surfaces (481*a*, 482*a*) integral with the slide, the X-shaped spring 600**) being designed to bias the slide towards its open position.

12. A feed device according to claim 11, characterised in that the said tray also has abutment surfaces (**561*a*, 561*b*, 562*a*, 562*b*) designed to cooperate with the ends (695*a*, 605*b*) of the second legs (605, 606) of the X-shaped spring, so as to bias the tray towards abutment (700, 720**) for positioning the sheets arranged on the slide, the abutment surfaces of the tray being continuous with the abutment surfaces of the slide when the latter comes close to the closed position.

13. A sheet-feeding device according to any one of claims 1 to 6, characterised in that the device further comprises members (800, 820) for retaining the pile of sheets when the top sheet of the pile is driven by the drive member (19).

14. A sheet-feeding device according to any one of claim 1 to 6, characterised in that the device further comprises locking means (900, 901, 903*a*) for locking the slide in the closed position.

15. An image forming apparatus, characterised in that the apparatus has a sheet-feeding device according to any one of claims 1 to 6 and image forming means for forming image on the sheet fed by said sheet-feeding device.

* * * * *

UNITED STATES PATENT AND TRADEMARK OFFICE

CERTIFICATE OF CORRECTION

PATENT NO. : 5,685,535
DATED : November 11, 1997
INVENTOR(S) : Stéphane MICHEL, et al.

It is certified that error appears in the above-indentified patent and that said Letters Patent is hereby corrected as shown below:

Title Page, [56], Foreign Patent Documents:
delete "02103162" and insert therefor --2-103162--;
delete "02113969" and insert therefor --2-113969--;
delete "3172234" and insert therefor --3-172234--.

Column 2, line 57, delete "a" and insert therefor --an--.

Column 6, line 27, delete "moulded" and insert therefor --molded--.

Column 7, line 12, delete "a".

Column 13, line 66, delete "BE" and insert therefor --8E--.

Column 15, lines 6 and 11, delete "terised", both occurrences, and insert therefor --terized--.

Column 16, lines 30, 37, 43 and 62, delete "characterised", each occurrence, and insert therefor --characterized--;
Line 55, delete "terised" and insert therefor --terized--;
Line 56, delete "603*a*", second occurrence, and insert therefor --604*a*--;
Line 60, insert a parentheses ("(") before "600".

UNITED STATES PATENT AND TRADEMARK OFFICE

CERTIFICATE OF CORRECTION

PATENT NO. : 5,685,535

DATED : November 11, 1997

INVENTOR(S) : Stéphane MICHEL, et al.

It is certified that error appears in the above-indentified patent and that said Letters Patent is hereby corrected as shown below:

Column 17, line 5 and 9, delete "characterised", both occurrences, and insert therefor --characterized--;
Line 8, delete "claim" and insert therefor --claims--.

Column 18, line 3, delete "characterised" and insert therefor --characterized--.

Signed and Sealed this

Twenty-third Day of June, 1998

*Attest:*

*Attesting Officer*

Bruce Lehman

BRUCE LEHMAN

*Commissioner of Patents and Trademarks*